US005544477A

United States Patent [19]

Rozenwasser

[11] Patent Number: 5,544,477

[45] Date of Patent: Aug. 13, 1996

[54] METHOD OF PRODUCING CHAIN LINKS FOR FINE JEWELRY ROPE CHAINS

[75] Inventor: David Rozenwasser, Savion, Israel

[73] Assignee: Avraham Moshe Rozenwasser, Savion, Israel

[21] Appl. No.: 547,348

[22] Filed: Oct. 24, 1995

Related U.S. Application Data

[63] Continuation-in-part of Ser. No. 264,568, Jun. 22, 1994, abandoned.

[30] Foreign Application Priority Data

Jun. 1, 1994 [IL] Israel ..... 109858

[51] Int. Cl.[6] ..... B21L 17/00

[52] U.S. Cl. ..... 59/13; 59/15; 59/16; 59/35.1

[58] Field of Search ..... 59/13, 15, 250, 59/16, 35.1, 17; 29/412

[56] References Cited

U.S. PATENT DOCUMENTS 5,309,704 5/1994 Grando ..... 59/13

*Primary Examiner*—David Jones
*Attorney, Agent, or Firm*—Helfgott & Karas, P.C.

[57] ABSTRACT

A commercially viable process for producing chain links suitable for use in making fine jewelry rope chains, said chain links having gaps for intertwining one link within another, comprising the steps of providing a sheet of precious metal of an appropriate thickness determined by the thickness of the link to be produced; piercing said sheet with a single punch from a mating punch and die set having the predetermined shape of the link to produce a finished link with a gap in the range of 0.2–0.7 mm which link is separated from said sheet; and recovering the link.

11 Claims, 2 Drawing Sheets

METHOD OF PRODUCING CHAIN LINKS FOR FINE JEWELRY ROPE CHAINS

This application is a continuation-in-part of application Set. No. 08/264,568, filed Jun. 23, 1994, now abandoned.

FIELD OF THE INVENTION

The present invention relates to a novel process for making chain links for use in making fine jewelry rope chains. Specifically, the process involves making chain links having sharp edged flat side walls rather than the traditional curved walls in a single step.

BACKGROUND OF THE INVENTION

Traditionally chain links for making rope chains are produced as follows. A precious metal wire, generally having a circular cross-section, is wound around a manedrel to form a spiral coil. The coil is then cut so that each loop is cut slightly askew of its adjacent loop, resulting in accentric wire links having gaps accentrically aligned. In order to straighten these accentric links to be planar, the links are passed between pressure rollers or other pressure means to force the gap ends into the same plane. An alternative way of making gapped links is by taking a wire of any shape cross-section, cutting it to the desired length of the outer circumference of a link and bending the wire around a former into the desired link shape by pressing the ends of the wire towards the body of the former.

Rope chains have been prepared for decades primarily by hand, using such gapped links. Even today this is by far the dominant method for preparing rope chains. A complete discussion of the manual process for making rope chains can be found in the patent to Benhamou et al, U.S. Pat. No. 4,651,517 and my own U.S. Pat. Nos. 4,934,135 and 4,996,835.

Machines for producing rope chains are also known as disclosed in U.S. Pat. Nos. 4,493,183 and 4,503,664. The machine process also uses wire to prepare the chain links. French Patent 2154 dated June 1846 discloses what appear to be punched jewelry articles in the form of gapped rings. The rings, however, are relatively large, with substantially wide gaps, much larger than the links used for making rope chains. This is quite evident from the scale at the bottom of the drawing. This scale represents a distance of 100 mm (0 to 1 decimeters) with each increment representing 10 mm. Thus the open ring-like articles in this patent all have diameters of about 20 mm and gaps of about 10 mm, as can be seen from the figures. Therefore, the patent relates only to relatively large individual jewelry articles with large open sections (gaps) which can readily made by a single punch method. The patent, however, does not suggest nor teach to use the single punch method for manufacturing rope chain links having very small diameters in the order of 2–5 mm with gaps as narrow as 0.2–0.7 mm. Recently a number of design patents were published, for example the International Design No. DM/014,648 to S.I.L.O. s.P.a. and U.S. Pat. Nos. Des. 340,422 and 343,136 which disclose rope chains and links for preparing these rope chains, having straight sided polygonal shapes such as squares, hexagons and octagons. Such shaped links are difficult to prepare from wire material, even from wires having polygonal cross-sections, because in bending the wire into the shape of a link, there are always rounded corners which require a further step to remove or straighten them.

Thus, using square or rectangular cross-section wire to prepare chain links generally tends to deform the wire cross-section at the bends in the course of bending it into the shape of a chain link. A recent patent to Grando, U.S. 5,309,704, claims a multi-punch process for making chain links with planar surfaces and sharp corners by using progressive punch and die sets to punch out chain links from a sheet of metal foil in a two punch process. This method involves piercing a sheet of metal of appropriate thickness with a first punch and die set, to create the interior of the link, and subsequently, in a second step, piercing the sheet with a blanking punch and die set to a predetermined shape to create the exterior of the link and separating the finished link from the sheet.

In this manner, the link which is produced has planar surfaces and planar sides orthogonal to said surfaces. This double punch process enabled making small links of almost any shape by providing suitable first and second punches of the desired shape. Essentially this process is an adaptation of the generally well-known process of double punching metal sheets or strips to make links for rope chains. It is believed that the double punching method was selected because a single punch method was thought to be non-viable on a commercial scale, because of the thin punch die required for making the gap.

SUMMARY OF THE INVENTION

It is an object of the present invention to provide a method of producing chain links with gaps for use in making fine jewelry rope chains.

It is a further object of the invention to provide a process for making rope chain links with gaps for fine jewelry in a single punch step.

Yet another object of the invention is to provide a single punch step method for making rope chain links with gaps for fine jewelry having planar side walls with sharp edges.

Still another object of the invention is to provide a single step method for making rope chain links with gaps having almost any circumferential configuration for use in the manufacture of fine jewelry rope chains.

These and other objectives are achieved by providing a sheet of precious metal of preselected thickness and punching out therefrom a gapped link with a single punch using a punch and die set defining the shape of the link.

It must be remembered that the links used in making rope chains have very small diameters and the wire or wall cross-section of the links are even smaller. Thus chain links for jewelry rope chains can range from 214 5 mm in outside diameter, and the wire or wall cross-sections of the links can be about 0.2–0.5 mm. The gap in these links is in the range of 0.2 to 0.7 mm. It is very probable that the constraint of these small dimensions dictated throughout the years the use of wire for making fine jewelry chain links. The Grando patent, mentioned above, using the double punching process, expands the capabilities for making chain links of such small diameter to include square and rectangular links with sharp edges both on the exterior and interior perimeters. This two punch process uses a first punching step to press out the hole of a link from a metal sheet and a second punching step to press out the link itself. It should be appreciated that both the punches and dies comprise substantial surface areas at the punch plane which are significantly larger than the gap of the link. The Grando process, however, has certain deficiencies. First of all, it is extremely critical that the metal sheet after it is punched by the first punch be aligned exactly in position for receiving the second punch, which determines the outer perimeter of the link. Any slight deviation of the metal strip from this exact predetermined position will result in a chain link having walls of unequal width. This may become a serious problem when a number of links are to be punched out in series simultaneously, as may be the case in an industrial process, since the slight error in the direction of movement of the metal strip with respect to the punches will result in the whole series of links being uneven.

I have discovered surprisingly that, despite the very small size of these links and gaps for fine Jewelry rope chains, it is possible to punch out links directly from a sheet or strip of precious metal with one single punching step by using a punch and die set in the shape of the link. It was surprisingly found that the very thin punching edge corresponding to the gap in the chain link is sufficiently strong to undergo many punching cycles.

Moreover, it was surprisingly found that this die comprising a very short and thin section, which may be as narrow as 0.4 mm or even 0.25 mm, can endure the punching process without breakage. I believe that the reason for this may be that the metal sheets used for making links for fine Jewelry rope chains are made of precious metals, such as silver, gold, platinum and their alloys, having sufficient softness and malleability to be punched without breaking the thin gap section in the die. These metals have a Mots hardness between 2.5–4.4 and preferably 5–4.

It will be appreciated that such a one-punch method for producing chain links has significant advantages over the two-punch method. First of all, the process can operate faster, since only one step is required. Furthermore, since the wall thickness is predetermined by the single punch, all the chain links will have a uniform wall dimension. Another advantage is the fact that there is no separate scrap to be collected from a first punch step, since that portion of the metal strip corresponding to the inner void of the link remains attached to the metal strip, making the punched out strip the only piece that requires recovery.

The remaining metal sheet from which the chain links have been punched out can be easily reclaimed and reprocessed into new metal sheets with suitable dimensions. Moreover, if the metal sheet is sufficiently wide, a series of links of graduated size can be punched out subsequent to the punching of the first initial link by using a larger corresponding punch and die set. In this way, a series of links of graduated size can be prepared from a single metal strip.

BRIEF DESCRIPTION OF THE DRAWINGS

The invention will be better understood as discussed with reference to the drawings, in which.

DETAILED DESCRIPTION OF THE DRAWINGS

Figure 2:
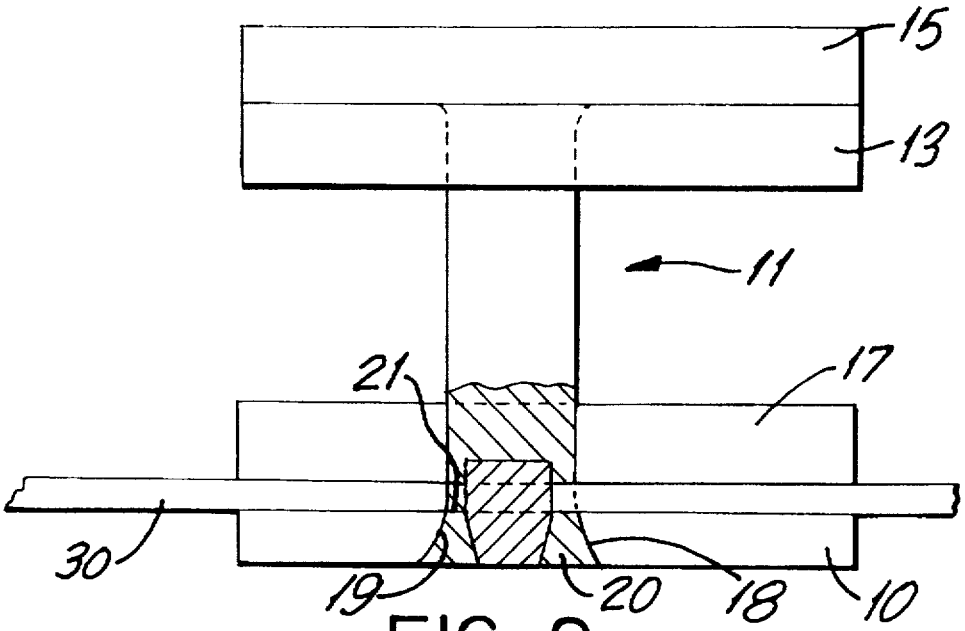
FIG. 2 is a side view of a punch and die according to the invention.
Figure 1:
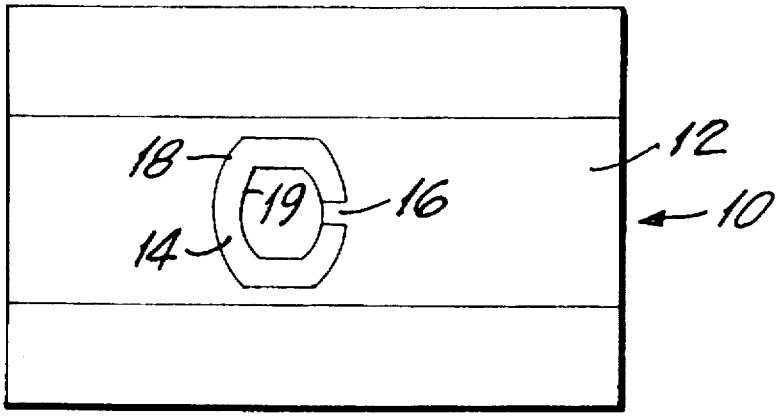
FIG. 1 is a top view of a single-punch die suitable for producing a chain link according to the present invention.

Referring now to FIGS. 1 and 2, there are shown a die 10 having a depressed indentation 12 to support a strip of metal 30 (FIG. 2). This indentation 12 is generally about the depth corresponding to the thickness of the metal strip. In the centre of the die 10 there is a groove 14 corresponding to the shape of the link that is to be produced. This groove is in the order of about 10 mm in depth. The section in die 10 which will form the gap of the link 16 is extremely thin and can range from about 0.25–0.5 mm. The exterior wall 18 of groove 14 is slanted outwardly as it descends from the surface of the die and inner wall 19 of groove 14 is slanted inwardly. The punch 11 is held in upper plate 13 and secured thereto by plate 15. A guide plate 17 having a hole through which piercing edge 21 penetrates, stabilizes the downward movement of the piercing edge 21. Piercing edge 21 has the shape of the groove 14 and mates therewith. Thus when a strip of metal 15 is placed into the depression 12 of die 10 overlapping the groove 14, punch 11 is lowered onto the metal strip 15 and cutting edge 21 presses into it, punching out therefrom a link having the shape of the groove 14. The link falls into the space 22 from where it is subsequently recovered. Thus in this single punching operation, a uniform walled link is produced. Punch 11 is then raised, the metal sheet is advanced and the process is repeated. In this manner, chain links can be continuously punched out from metal sheet strips with all chain links having uniformly dimensioned walls.

Figure 3:
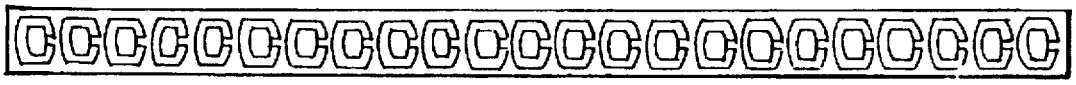
FIG. 3 shows a strip of metal sheet after chain links have been punched out therefrom.
Figure 4:
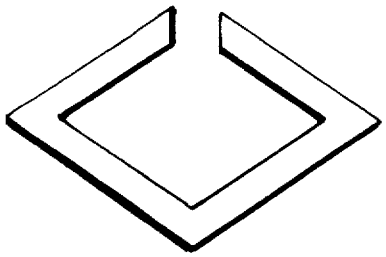
FIGS. 4–8 are different shaped links punched out from the metal strips in the single-punch process in accordance with the present invention.
Figure 7:
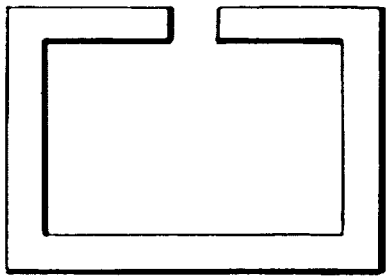
Figure 5:
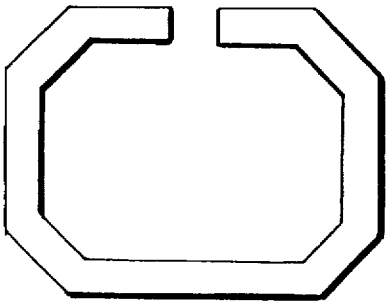
Figure 8:
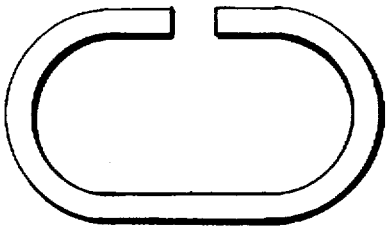
Figure 6:
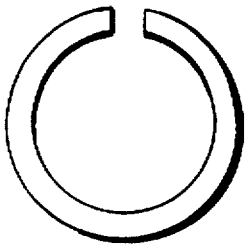

Such a metal strip from which chain links have been punched out in the single step is illustrated in FIG. 3.

FIGS. 4–8 illustrate some of the link shapes that can be produced in accordance with this invention.

It will be appreciated by persons skilled in the art that the scope of the present invention is not limited to what has been described hereinabove by way of example. Rather, the scope of the invention is limited solely by the claims which follow.

I claim:

1. A commercially viable process for producing chain links suitable for use in making fine jewelry rope chains, said chain links having gaps for intertwining one link within another, comprising the steps of:

a) providing a sheet of precious metal selected from silver, gold, platinum, and their alloys having a Mohs hardness of at least 2.5; said sheet of precious metal being of an appropriate thickness determined by the thickness of the link to be produced;

b) piercing said sheet with a single punch from a mating punch and die set having the predetermined shape of the link to produce a finished link with a gap in the range of 0.2–0.7 mm which link is separated from said sheet; and c) recovering the link.

2. A process in accordance with claim 1, wherein the metal sheet has a thickness of 0.2–0.5 mm.

3. A process in accordance with claim 1, wherein the link has a wall thickness of 0.2–0.5 mm.

4. A process in accordance with claim 1, wherein the punch and die set has a configuration for producing a square link.

5. A process in accordance with claim 1, wherein the punch and die set has a configuration for producing a round link.

6. A process in accordance with claim 1, wherein the punch and die set has a configuration for producing a oval link.

7. A process in accordance with claim 1, wherein the punch and die set has a configuration for producing a rectangular link.

8. A process in accordance with claim 1, wherein the punch and die set has a configuration for producing a link in the shape of a parallelogram.

9. A process in accordance with claim 1, wherein the punch and die set has a configuration for producing a link in the shape of a hexagon.

10. A process in accordance with claim 1, wherein the punch and die set has a configuration for producing a link in the shape of an octagon.

11. A process in accordance with claim 1, wherein the punch and die set has a configuration for producing a link in the shape of a complex curve.

* * * * *